US012584637B2

(12) United States Patent
Braun et al.

(10) Patent No.: US 12,584,637 B2
(45) Date of Patent: Mar. 24, 2026

(54) HOUSEHOLD APPLIANCE

(71) Applicant: Paul Hettich GmbH & Co. KG, Kirchlengern (DE)

(72) Inventors: Johann Braun, Hiddenhausen (DE); Johann-Sebastian Lessmann, Loehne (DE); Artur Noak, Bad Oeynhausen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 141 days.

(21) Appl. No.: 18/604,790

(22) Filed: Mar. 14, 2024

(65) Prior Publication Data

US 2024/0315524 A1 Sep. 26, 2024

Related U.S. Application Data

(63) Continuation of application No. PCT/EP2023/057701, filed on Mar. 24, 2023.

(51) Int. Cl.

| | |
|---|---|
| ***F24C 15/16*** | (2006.01) |
| ***A47B 88/57*** | (2017.01) |
| ***A47L 15/50*** | (2006.01) |
| *A47L 15/42* | (2006.01) |

(52) U.S. Cl.
CPC ..... *F24C 15/16* (2013.01); *A47B 88/57* (2017.01); *A47L 15/507* (2013.01); *A47L 15/4259* (2013.01); *F24C 15/168* (2013.01)

(58) Field of Classification Search
CPC .... A47L 15/507; A47L 15/4259; F24C 15/16; F24C 15/168; A47B 88/57
See application file for complete search history.

(56) References Cited

U.S. PATENT DOCUMENTS

| | | | | |
|---|---|---|---|---|
| 10,548,396 | B1 | 2/2020 | Hong | |
| 10,876,737 | B2 | 12/2020 | Kubtan et al. | |
| 2012/0097147 | A1 | 4/2012 | Steurer et al. | |
| 2020/0337496 | A1 * | 10/2020 | Peter | A47J 36/34 |
| 2021/0071876 | A1 | 3/2021 | Heffel | |

OTHER PUBLICATIONS

International Search Report in PCT/EP2023/057701, mailed Sep. 14, 2023, with English Translation.

* cited by examiner

*Primary Examiner* — Michael E Barr
*Assistant Examiner* — Kevin G Lee
(74) *Attorney, Agent, or Firm* — Collard & Roe, P.C.

(57) ABSTRACT

A household appliance includes an interior space for accommodating a rack system, and a wall element on opposite sides of the interior space. A locking projection is arranged on at least one of the wall elements. The rack system has a stationary part arranged in the interior space and a part movable at least partially in front of the interior space via guides. A locking element is provided on the stationary part for detachable engagement with the locking projection, which can be moved into an unlocked position via a driver on the movable part. The locking element can be moved from the unlocked position into the locked position exclusively by gravity and moved into the unlocked position via the driver, and can be moved via the driver from a lowered locking position into a raised unlocked position or from a raised locking position into a lowered unlocked position.

15 Claims, 24 Drawing Sheets

HOUSEHOLD APPLIANCE

CROSS REFERENCE TO RELATED APPLICATIONS

This application is a continuation of and Applicant claims priority under 35 U.S.C. § 120 of International Application No. PCT/EP2023/057701 filed on Mar. 24, 2023. The international application under PCT article 21(2) was not published in English. The disclosures of the aforesaid International Application is incorporated by reference.

BACKGROUND OF THE INVENTION

1. Field of the Invention

The present invention relates to a household appliance with an interior space for accommodating a rack system, wherein a wall element is provided on opposite sides of the interior space and a locking projection is arranged on at least one of the wall elements, wherein the rack system comprises a stationary part arranged in the interior space and a part which can be moved at least partially in front of the interior space via guides, and a locking element is provided on the stationary part for detachable engagement with the locking projection, which can be moved into an unlocked position via a driver on the movable part.

2. Description of the Related Art

In US 2012/0097147 A1, a baking oven is disclosed in which a rack system is arranged in an interior space. The rack system includes a stationary part that remains in the baking oven and a part that can be pulled out on the interior space. When the movable part of the rack system is pulled out, a rotatable latch ensures that the stationary part is locked in the baking oven. This increases safety when handling and preparing food. The latch is pretensioned into the locked position by a spring and can be brought into engagement with a projection for locking. When the movable part is retracted, a driver ensures that the latch swivels against the spring force for unlocking. The use of a spring in the baking oven is disadvantageous because, particularly at high temperatures, for example during pyrolytic cleaning, damage can be associated with an impairment of the pre-tensioning force. In addition, the locking mechanism requires numerous components, which makes assembly and production time-consuming.

U.S. Pat. No. 10,548,396 B1 shows a sliding device for a movable grate which can be moved on opposite sides via a guide in the pull-out direction. A hook is provided at the rear end of a stationary part, which can be moved against the force of a spring when the rack is pushed into a raised position. When the rack is pulled out, the hook engages behind a lock on the rear wall and is pretensioned into the locked position by the spring. The locking mechanism therefore requires additional construction space. A similar rack device is also shown in US 2021/0071876 A1.

U.S. Pat. No. 10,876,737 B2 shows a rack device with a stationary part and a movable part, in which a lever is pretensioned into a raised position via a spring for locking. In the retracted position of the movable part, the lever can be pressed down against the force of the spring.

SUMMARY OF THE INVENTION

It is therefore the object of the present invention to create a household appliance in which a rack system can be reliably locked in an interior space by simple means.

This object is achieved with a household appliance having an interior space for accommodating a rack system, wherein a wall element is provided on opposite sides of the interior space and a locking projection is arranged on at least one of the wall elements.

In the household appliance according to the invention, the rack system can be brought into detachable engagement with the locking projection on the wall element via at least one locking element, the locking element being movable via a driver on the movable part of the rack system, and the locking element being movable from a locking position into an unlocked position via the driver. The locking element is moved via the driver from a lowered locking position to a raised unlocked position or from a raised locking position to a lowered unlocked position. This allows the driver to move or swivel the locking element via a run-up slope, for example, and move it into the raised position so that the locking element can be automatically moved back into the lowered position when the driver is moved in the pull-out direction. This enables a simple design of the locking mechanism and reliable locking.

According to the invention, the locking element can be moved from the unlocked position to the locked position solely by gravity. The locking element therefore does not have to be preloaded into the locking position by a mechanical spring, so that the problem of susceptibility to errors due to a spring is avoided.

The lifting of the locking element from the lowered locking position to the raised unlocked position relates to the center of gravity of the locking element, which is lower in the lowered locking position than in the raised unlocked position. The movement of the locking element between these positions is preferably a sliding movement, a rotating movement or a combined sliding and rotating movement. For a rotational movement, the locking element can be mounted with a bearing section rotatable about an axis, preferably about a horizontal axis or about an axis inclined to the horizontal.

The locking element is preferably pivotably mounted on the stationary part. The locking element can be rotatable about an axis that extends essentially parallel to the pull-out direction of the movable part. The locking element can be swiveled into a raised position by the driver, which is formed for example by an integral section of the stationary part, in order to effect unlocking. Here, the locking element can be easily mounted on the stationary part if a bracket is fixed to it, which forms a bearing receptable for the pivotable locking element. The bracket can be welded to the grate-shaped stationary part, for example.

Preferably, the locking projection is arranged in the area of a front half of the wall element in relation to a pull-out direction of the movable part. This results in a compact design and the rack system can be manufactured with the identical locking mechanism in different lengths.

For stable locking, a locking section provided on the locking element can be subjected to pressure when a tensile force is applied to the stationary part in the pull-out direction. The locking section is in contact with a contact surface on the locking projection and extends up to a bearing or retaining section on the stationary part. The locking section can thus reliably absorb high forces.

In a further embodiment, the locking element includes an actuating section which can be brought into engagement with the driver, a locking section which can be applied to the locking projection and a bearing section for rotatable mounting of the locking element, the bearing section being arranged between the actuating section and the locking section. The locking element thus forms a double lever, in which the bearing section is provided in a central area and the actuating section and the locking section are provided on opposite sides of the bearing section, whereby "opposite" does not refer spatially to an opposite arrangement, but only to the design as a double lever, in which the bearing section is arranged between different levers, but which are rotatable together. The double lever can be formed in one or more parts.

The locking element preferably comprises a cantilever by means of which the locking section of the locking element is biased into a raised, locked position by gravity. The cantilever can be formed as a lever, for example, which biases the locking element in a predetermined direction of rotation by gravity.

The driver is preferably arranged vertically above an actuating section of the locking element and presses the actuating section downwards when the movable part is in the run-in position. The actuating section can then be moved upwards, in particular swiveled, when the movable part is extended.

The locking element is preferably formed from a bent wire, so that functionality is guaranteed even at high temperatures. The locking element may comprise an actuating section that interacts with the driver on the movable part and ensures pivoting movement of the locking element. In addition, the locking element can comprise an integrally formed locking section that can be moved towards the wall element and can be moved into engagement with the locking projection. By forming the locking element as a bent wire, the amount of material used can be kept to a minimum and, in addition, only little noise is generated when the locking element is swiveled.

For smooth handling of the rack system, the stationary part can include a first rail and the movable part a second rail, which are held together in a displaceable manner via rolling elements. Optionally, a center rail that extends the extension can be provided between the first rail and the second rail, depending on how far the movable part of the rack system is to be moved in front of the interior space. Preferably, the rails are part of a pull-out guide arranged between the stationary part and the movable part of the rack system. The rack system thus forms a compact unit that can be easily removed from the interior space of the baking oven.

For secure locking of the rack system, a locking element can be provided on the stationary part adjacent to each wall element, which can be brought into engagement with a locking projection. As a result, the stationary part is locked on opposite sides when the movable part of the rack system is pulled out of the interior space. The locking element can be formed by a bent wire, a metal sheet or hook-shaped elements. The locking element preferably engages in the center of a locking projection near the rear wall or a side grate.

In a first variant, the locking projection on a wall element is made from an embossed metal sheet. Optionally, the locking projection can be formed integrally with a support strip, which serves to hold the stationary part of the rack system, whereby the locking projection is produced, for example, by a V-shaped embossment. In a second variant, the locking projection is formed on a side grate, which is fixed to a wall on the interior space.

In a preferred embodiment, the household appliance is formed as a baking oven. Alternatively, the household appliance can also be designed as a microwave, steamer or other appliance for preparing food.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
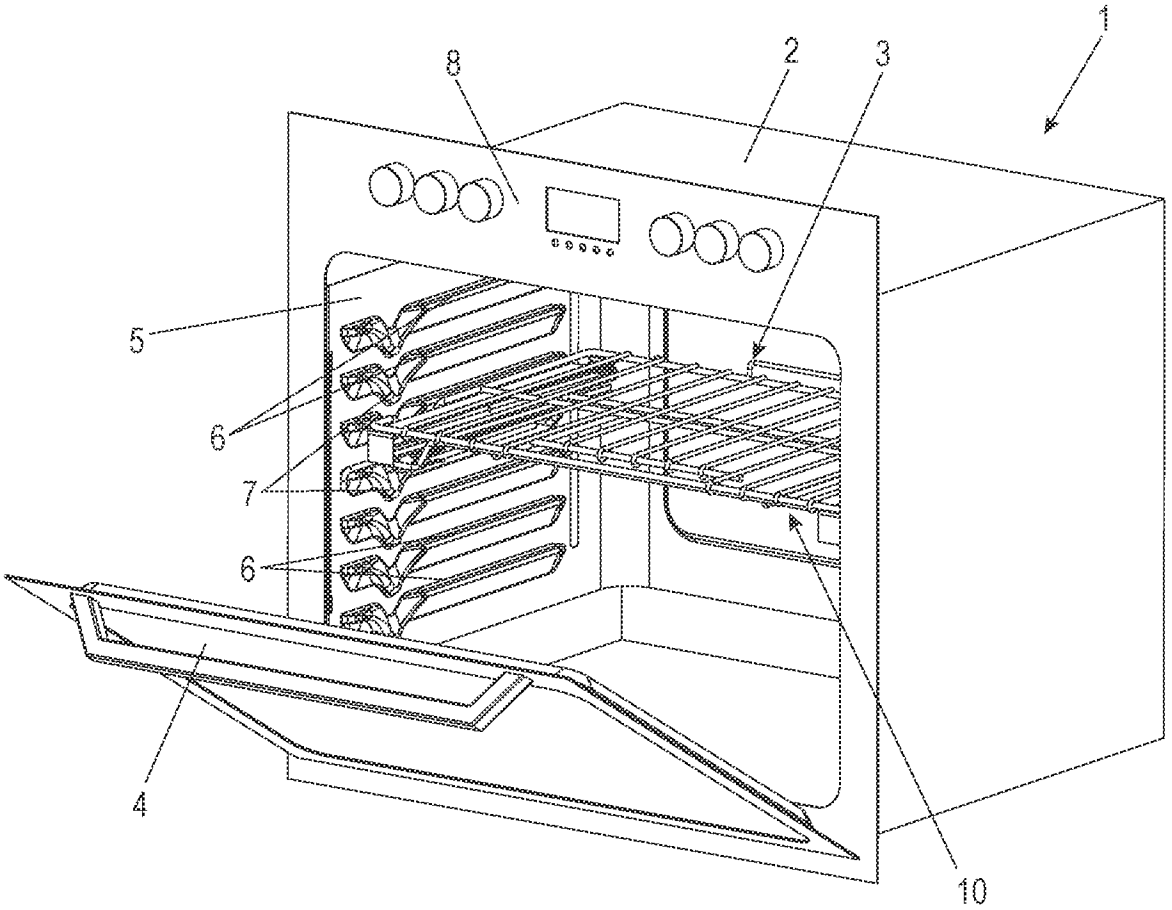
FIG. 1 shows a perspective view of a household appliance according to the invention.

A household appliance 1 is formed as a baking oven and includes a housing 2, in particular made of a metal sheet, in which an interior space 3 is provided. The interior space 3 is open on a front side and can be closed by a pivotable door 4.

A wall element 5 is provided on opposite sides of the interior space 3, which is made of a profiled metal sheet and comprises several support strips 6 for supporting food supports or one or more rack systems 10. A locking projection 7 is formed on each support strip 6, which is implemented as an inwardly projecting V-shaped embossment, but can also be provided with other geometries on the wall element 5.

Figure 2:
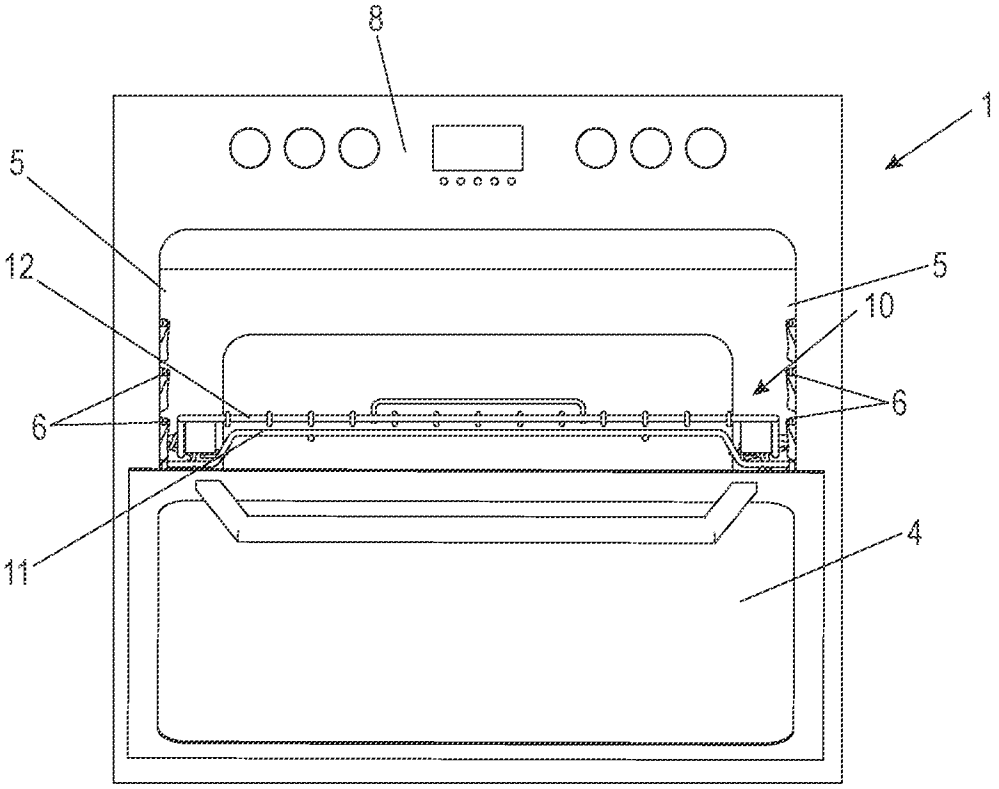
FIG. 2 shows a front view of the household appliance of FIG. 1.

As can be seen in FIG. 2, the rack system 10 includes a stationary part 11, which rests on support strips 6 on opposite sides and remains in the interior space 3. Furthermore, the rack system 10 includes a movable part 12, which is held on opposite sides via guides on the stationary part 11 and can be moved into a position in front of the interior space 3. If the movable part 12 is moved by the stationary part 11 into a pull-out position, the stationary part 11 is fixed to a wall element 5 via at least one locking mechanism.

Figure 3:
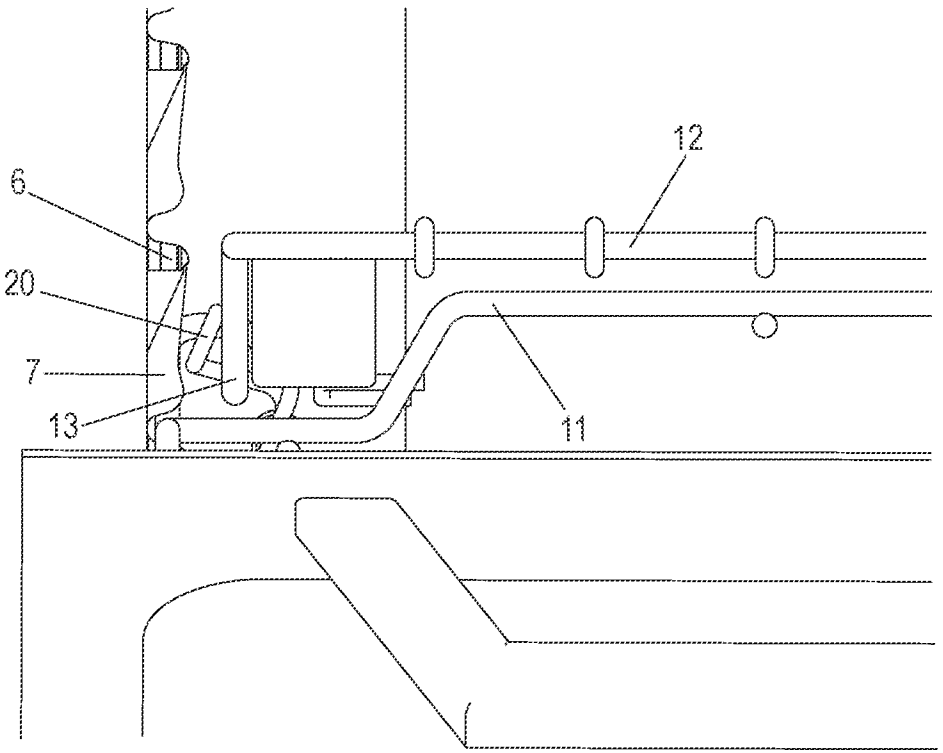
FIG. 3 shows a detailed view of the household appliance in the rack system area.

FIG. 3 shows a locking element 20 of the locking mechanism, which is pivotably held on the stationary part 11. The locking element 20 is shown in an unlocked, raised position and can swivel anti-clockwise when the movable part 12 is pulled out, so that a part of the locking element 20 moves behind the locking projection 7 and locks the stationary part 11 against being pulled out. The locking element 20 can be moved by a driver 13, which is formed on the movable part 12 of the rack system 10.

Figure 4A:
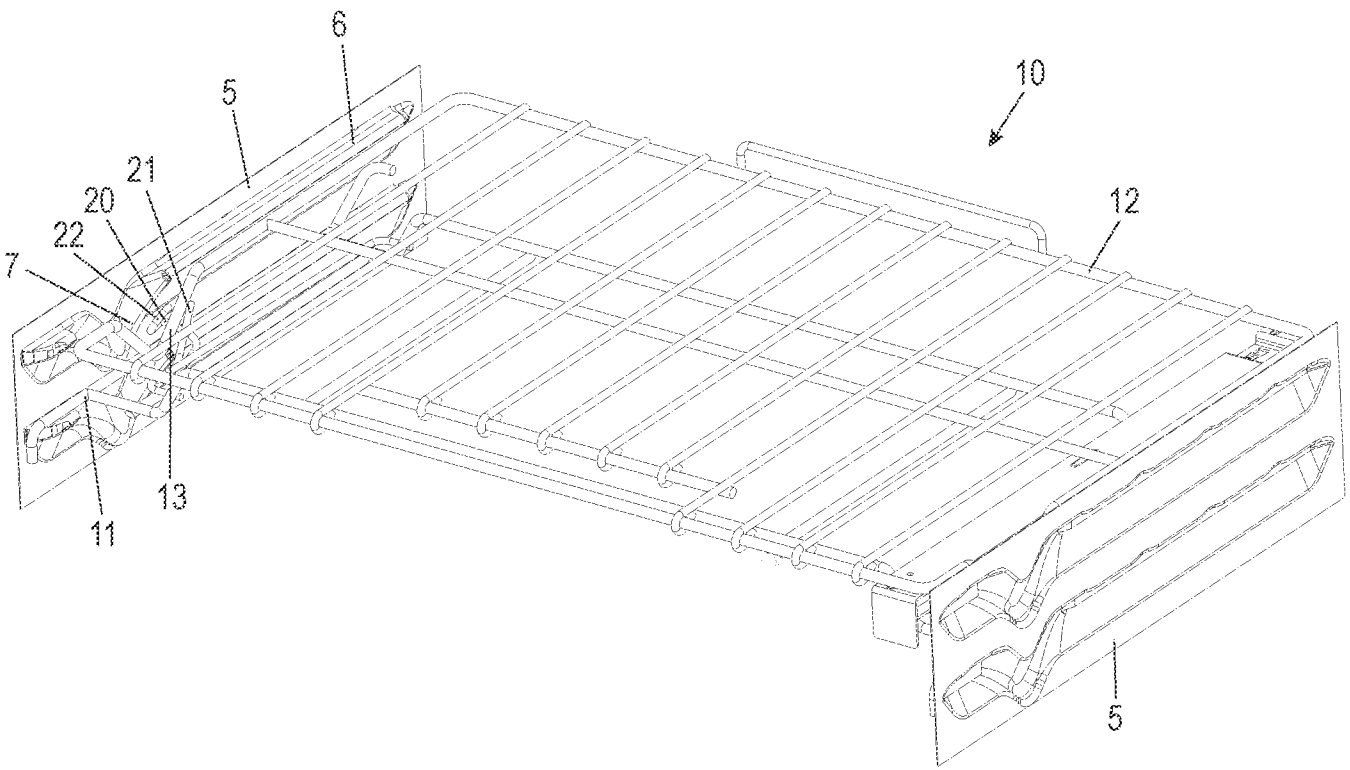
FIGS. 4A and 4B show two perspective views of a rack system in different positions.
Figure 4B:
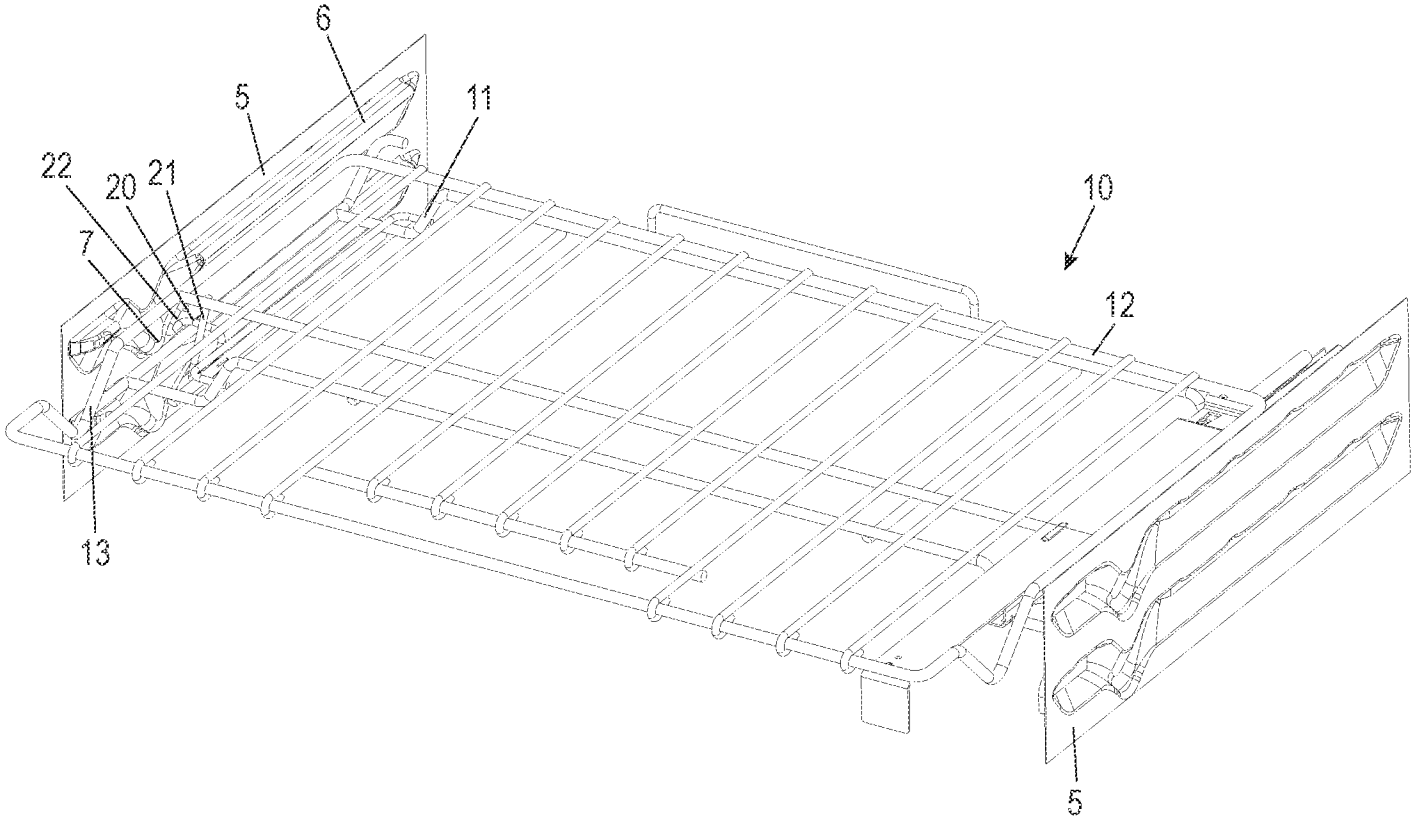

FIG. 4A shows a rack system 10 with a section of the wall elements 5 in a run-in and unlocked position. The movable part 12 of the rack system 10 is held on the stationary part 11 via guides, in particular pull-out guides, and is formed by a grate. Optionally, the movable part 12 can also be formed as a baking tray or other support. The stationary part 11 is also formed as a grate or rack and is supported on opposite sides on support strips 6. In the run-in position, the rack system is arranged such that the driver 13 on the movable part 12 holds the locking element 20 in an unlocked position via an actuating section 21 and the rack system 10 can be pulled out of the interior space 3 as a unit. The rack system 10 is shown in FIG. 4B in a pull-out position, as the movable part 12 has been moved relative to the stationary part 11 in the pull-out direction. As a result, the driver 13 has moved away from the actuating section 21 of the locking element 20, and this engages with a locking section 22 behind the locking projection 7, so that the stationary part 11 is locked to the wall 5.

Figure 5A:
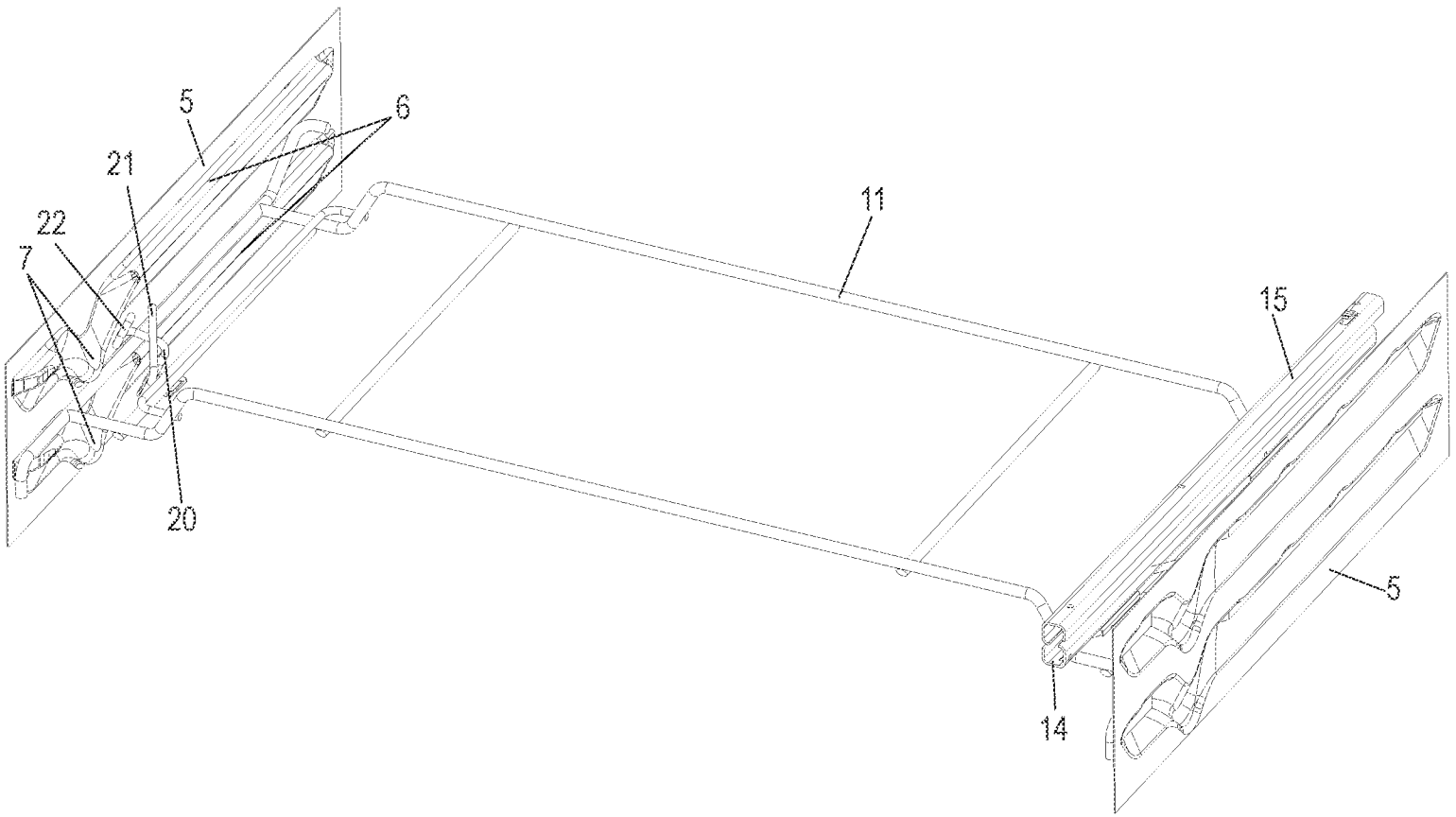
FIGS. 5A and B show two views of the rack system in FIGS. 4A and 4B without the movable part.

In FIG. 5A, only the stationary part 11 of the rack system 10 is shown in an unlocked position, resting on the support strips 6 of the walls 5. The locking element 20 is rotatably mounted on the stationary part 11, with the axis of rotation extending parallel to the pull-out direction. It can also be seen that the movable part 12 is held movably on the stationary part 11 via a pull-out guide and the pull-out guide includes a stationary rail 14 and a movable rail 15, which are held together via rolling elements. Optionally, a center rail extending the pull-out guide can be arranged between the stationary rail 14 and the movable rail 15. Instead of a pull-out guide with rolling elements, a sliding guide can also be provided between the stationary part 11 and the movable part 12.

Figure 5B:
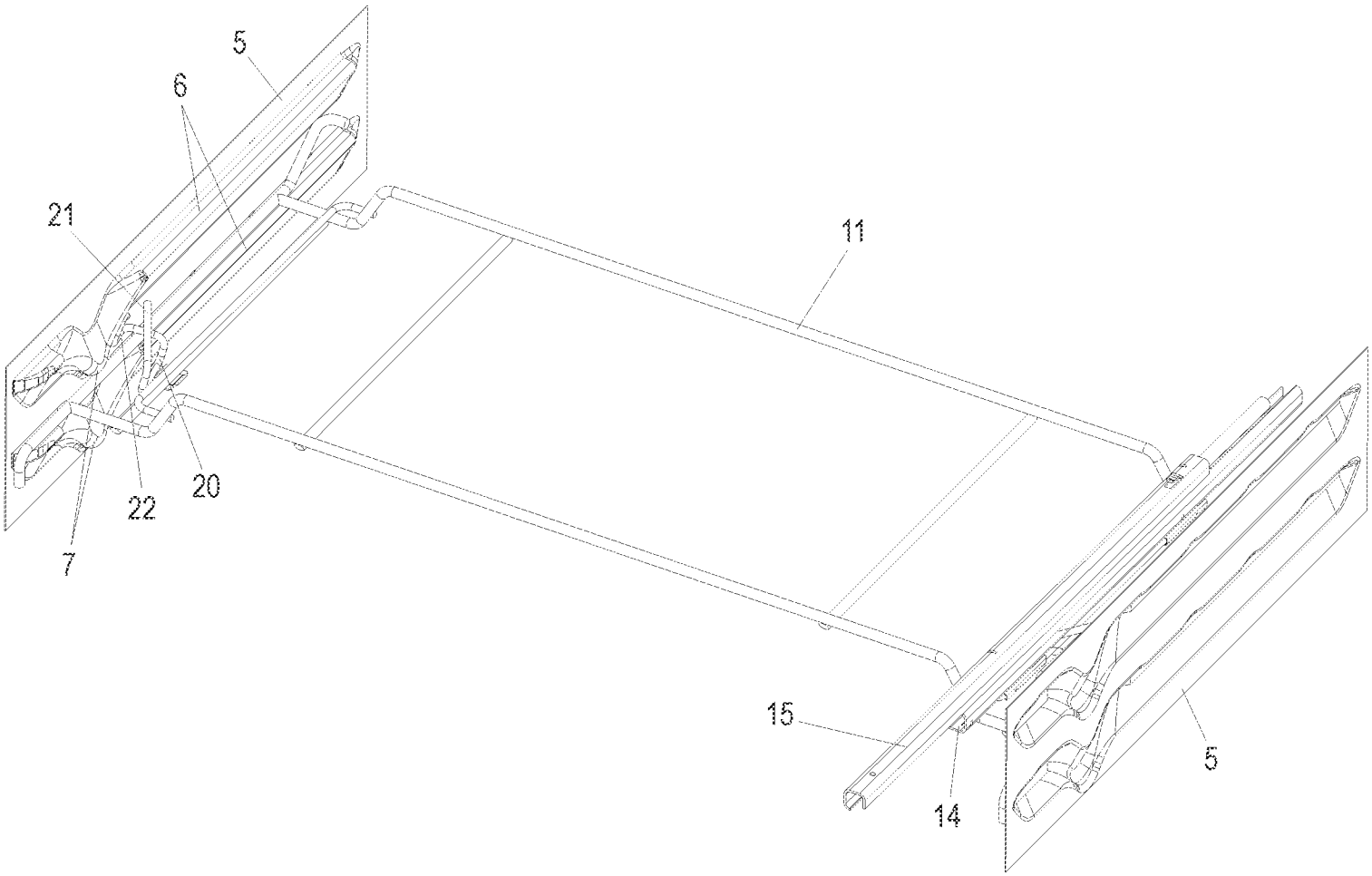

In FIG. 5B, the stationary part 11 is shown in a locked position when the movable rail 15 has moved in the pull-out direction with the movable part 12, which is not shown. The locking element 20 then swivels into the locking position behind the locking projection 7.

Figure 6A:
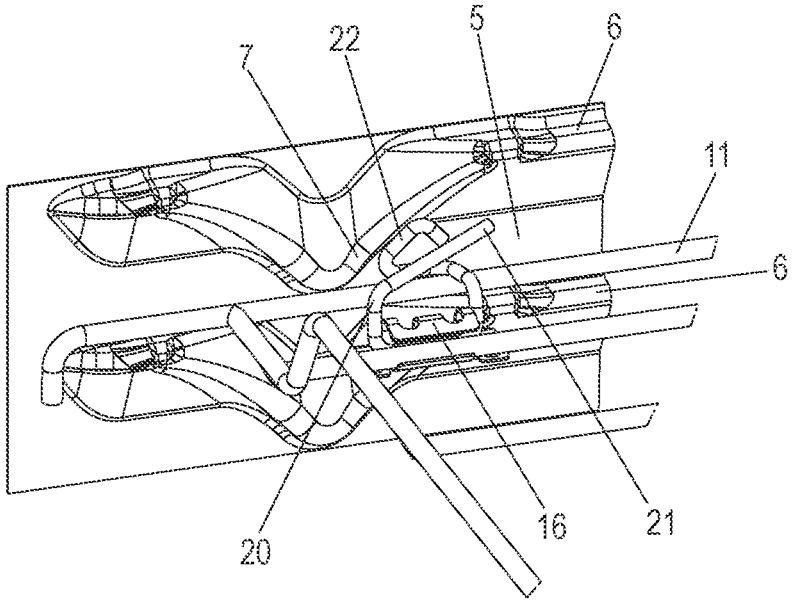
FIGS. 6A to 6C show several detailed views of a locking mechanism for the rack system in different positions.
Figure 6B:
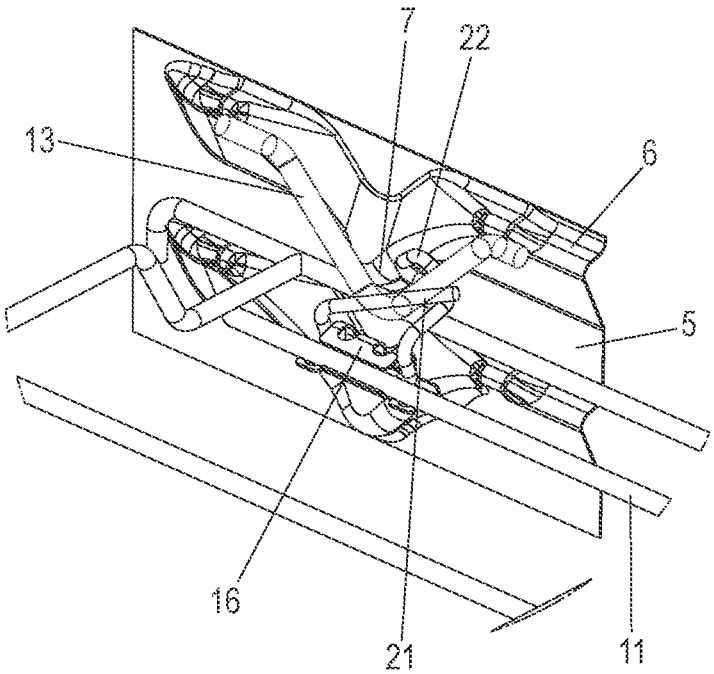
Figure 6C:
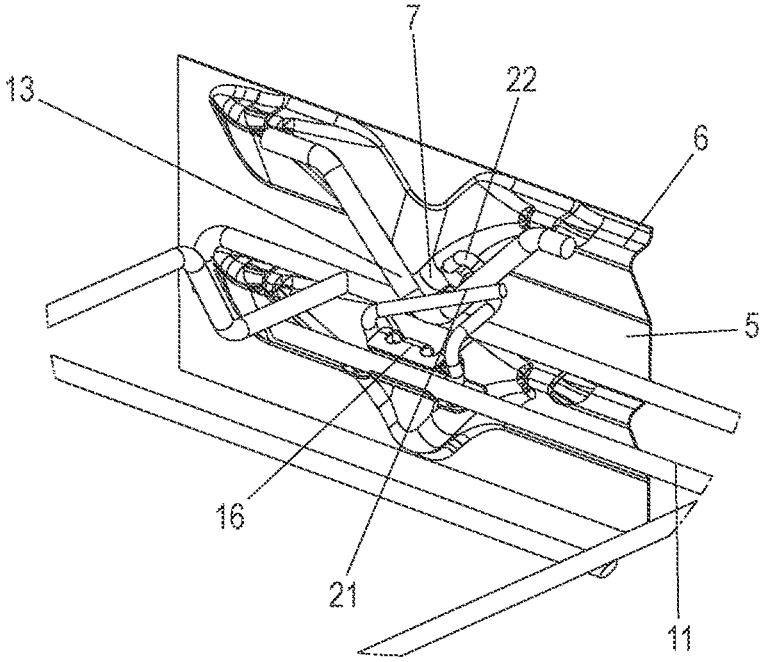

In FIGS. 6A to 6C, the locking mechanism is shown in different positions. In FIG. 6A, the locking element 20 is in a locked position, and a locking section 22 of the locking element 20 is arranged behind the locking projection 7 in the pull-out direction, so that the stationary part 11 is blocked in the pull-out direction. The locking element 20 is rotatably held on a bracket 16, which forms a bearing receptable. The bracket 16 can be welded to a rod of the stationary part 11. The locking element 20 also comprises an actuating section 21 projecting obliquely upwards.

FIG. 6B shows that the driver 13 on the movable part 12 can contact the actuating section 21 so that the actuating section 21 is swiveled away from the wall element 5. The driver 13 is formed as a V-shaped section of a bent wire, but can also have a different shape.

FIG. 6C shows an unlocked position of the locking element 20. The actuating section 21 has been moved by the driver 13 along a run-up slope on the driver 13, so that the locking section 22 has been swiveled away from the wall element 5. In this position, the rack system 10 can be removed as a unit from the interior space 3.

Figure 7A:
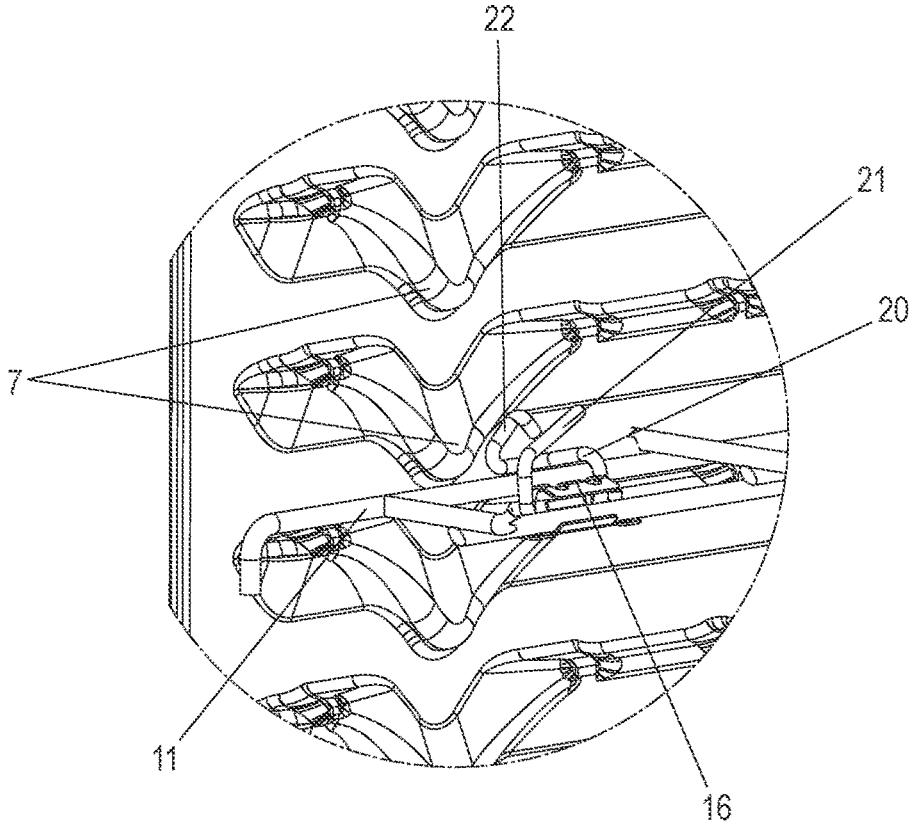
FIGS. 7A and 7B show two views of the locking mechanism in the locked position.
Figure 7B:
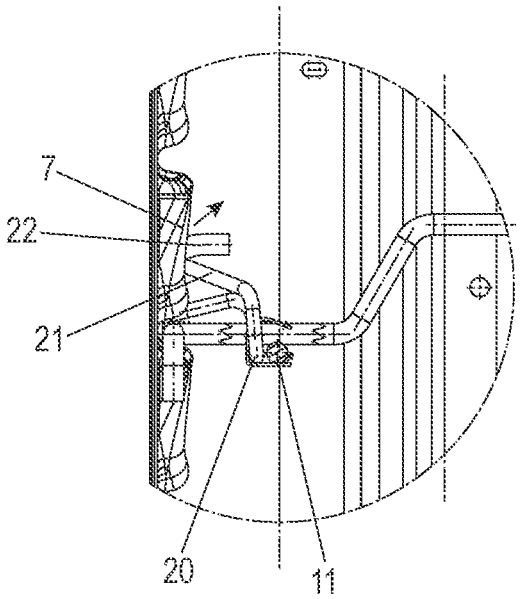

In FIGS. 7A and 7B, the locking element 20 is shown in the locked position. The bracket 16 forms a bearing receptable for a part of the locking element 20, and the locking section 22 can be obliquely swiveled upwards in a clockwise direction for unlocking, as shown in FIG. 7B. In the unlocked position, the locking element 20 is thus in a higher position relative to the center of gravity than in a locked position. The locking section 22 and thus the locking element 20 can thus swivel automatically into the locking position by gravity when the movable part 11 is pulled out.

Figure 8:
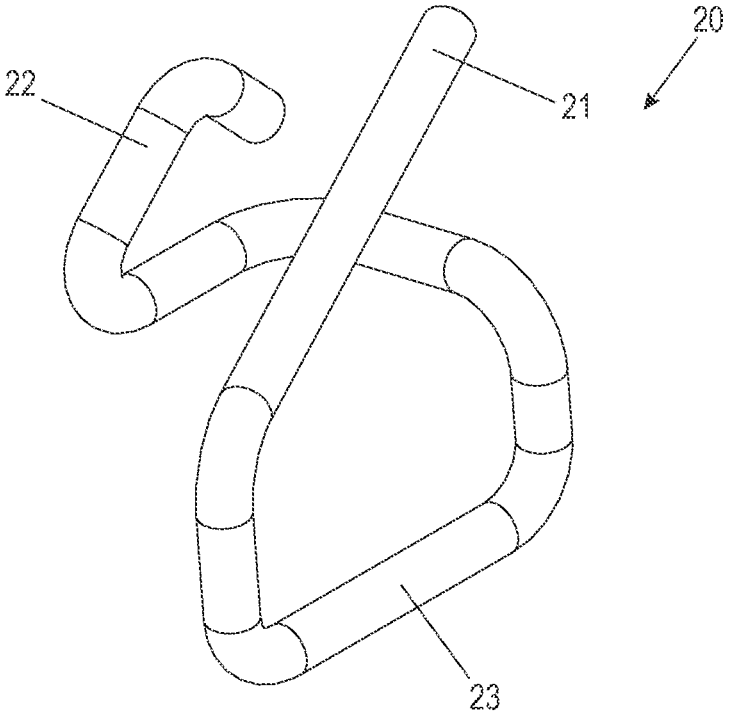
FIG. 8 shows a detailed view of the locking element for the locking mechanism.

FIG. 8 shows the locking element 20, which is made of a bent metallic wire. The locking element 20 includes the rod-shaped actuating section 21, which is formed integrally with a bearing section 23 arranged in the bearing receptable of the bracket 16. The locking section 22, which can come into contact with the locking projection 7, is also formed integrally with the bearing section 23.

Figure 9:
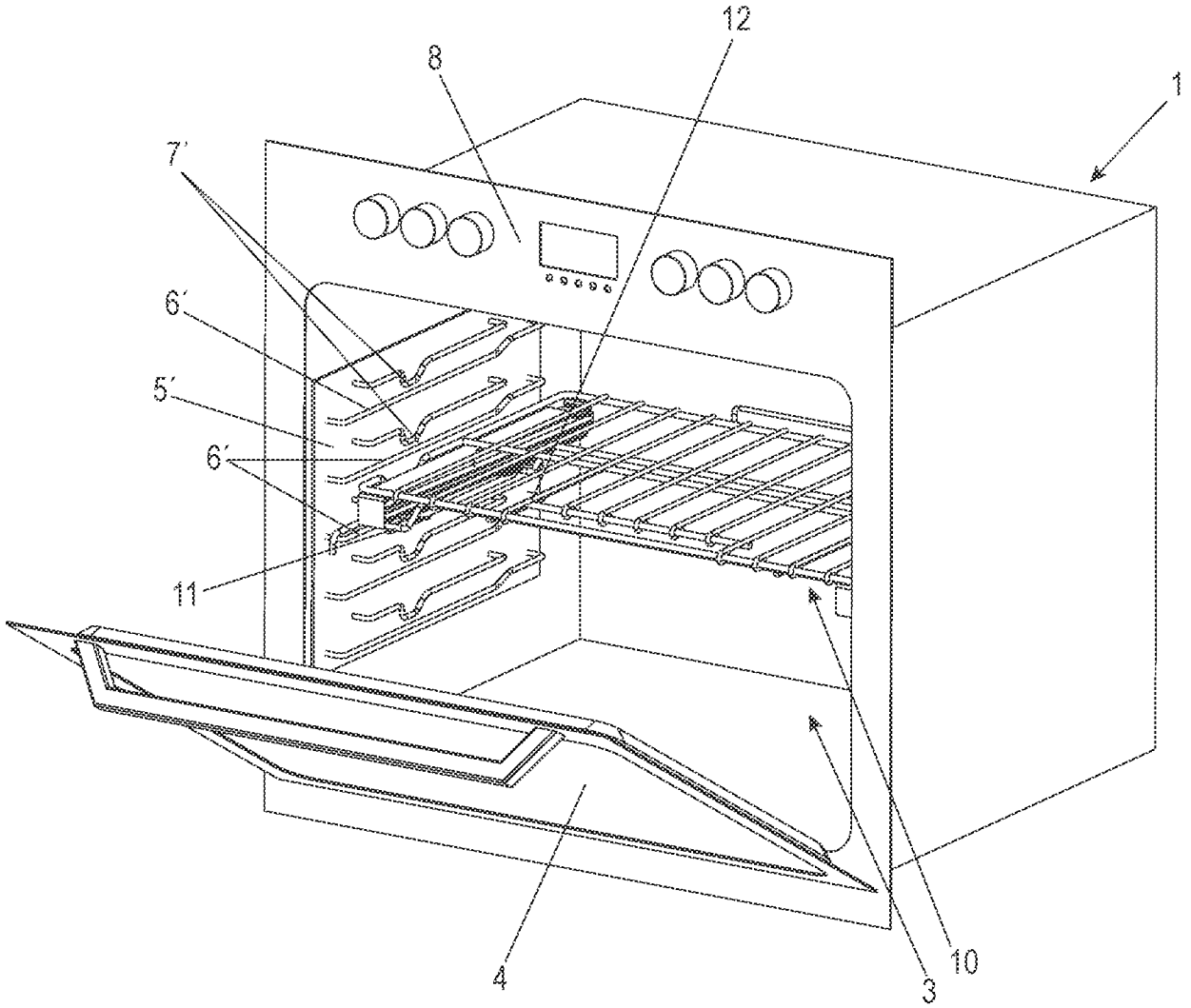
FIG. 9 shows a perspective view of a modified household appliance.

FIG. 9 shows a modified household appliance 1 comprising an interior space 3 with a rack system 10, as in the previous embodiment example, but a wall element 5' is provided which is not formed from an embossed metal sheet, but includes a side grate with horizontal rods 6' for supporting the rack system 10. The side grate also includes rods with an integrally formed locking projection 7', which are formed by profiling the wire. The wall element 5' can be formed entirely as a side grate and can be fixed to a wall at the interior space 3.

Figure 10:
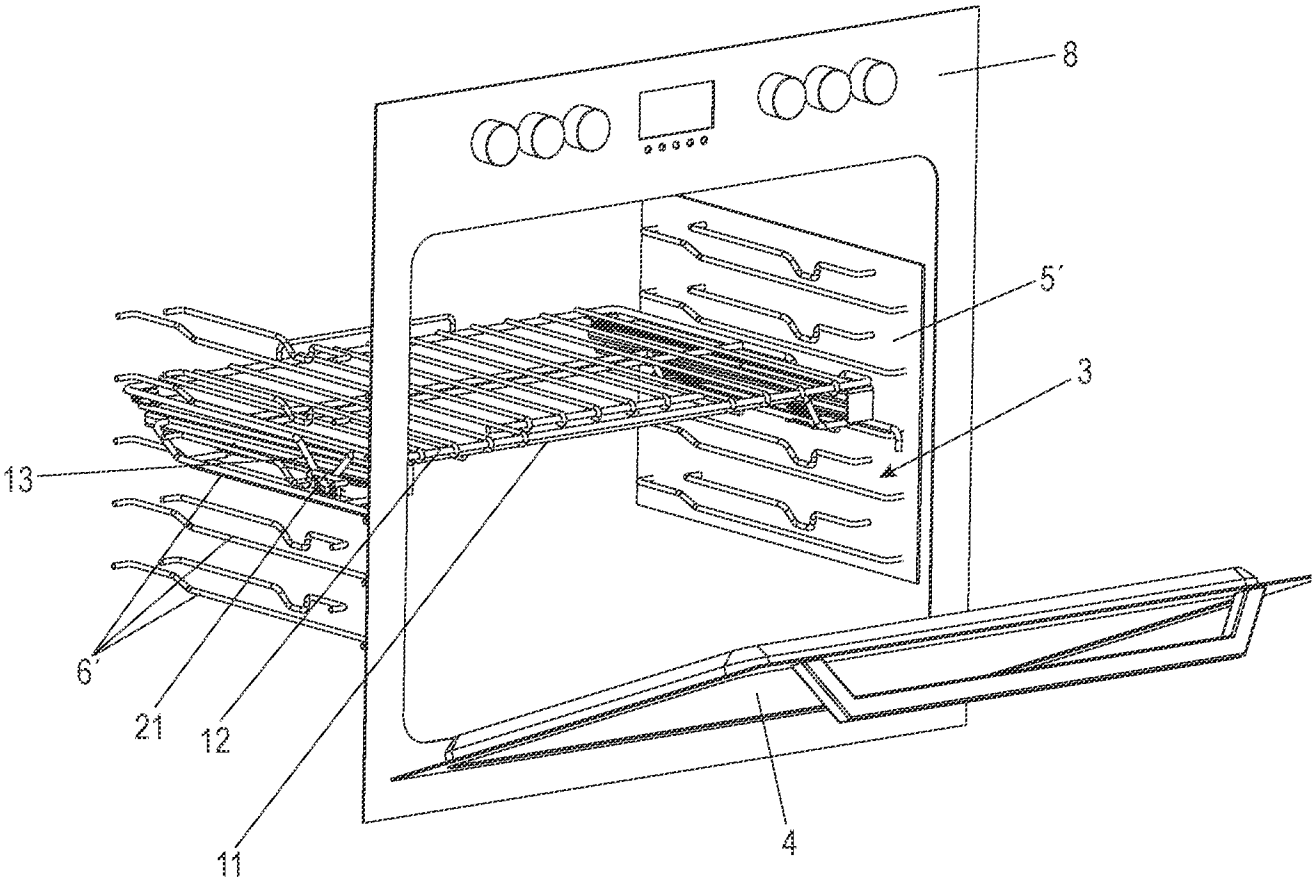
FIG. 10 shows a view of the household appliance of FIG. 9 with only one wall element.

In FIG. 10, the household appliance 1 is shown without the wall element 5', and it can be seen that the driver 13 of the movable part 12 of the rack system 10 contacts an actuating section 21 of a locking element 20 so that the locking element is moved into the unlocked position. Furthermore, as in the previous embodiment example, the rack system 10 includes pull-out guides on opposite sides between the movable part 12 and the stationary part 11.

Figure 11:
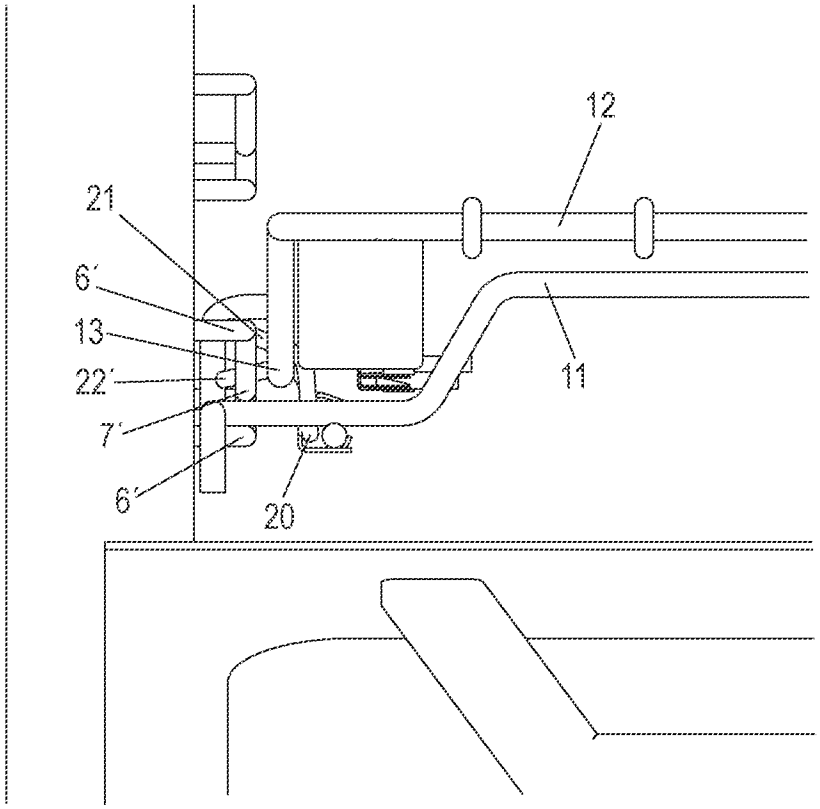
FIG. 11 shows a detailed view of the locking mechanism of the household appliance in FIG. 9.

FIG. 11 shows the locking mechanism of the household appliance 1 of FIG. 9. The locking element 20 includes an obliquely upwardly projecting actuating section 21, which can be contacted by the driver 13 to pivot the locking element 20 during retraction. The locking element 20 is in the lowered position, and a locking section 22 engages behind a locking projection 7' so that the rack system 10 cannot be pulled out of the interior space 3. The rack system 10 rests with the stationary part 11 on a support strip 6'.

Figure 12:
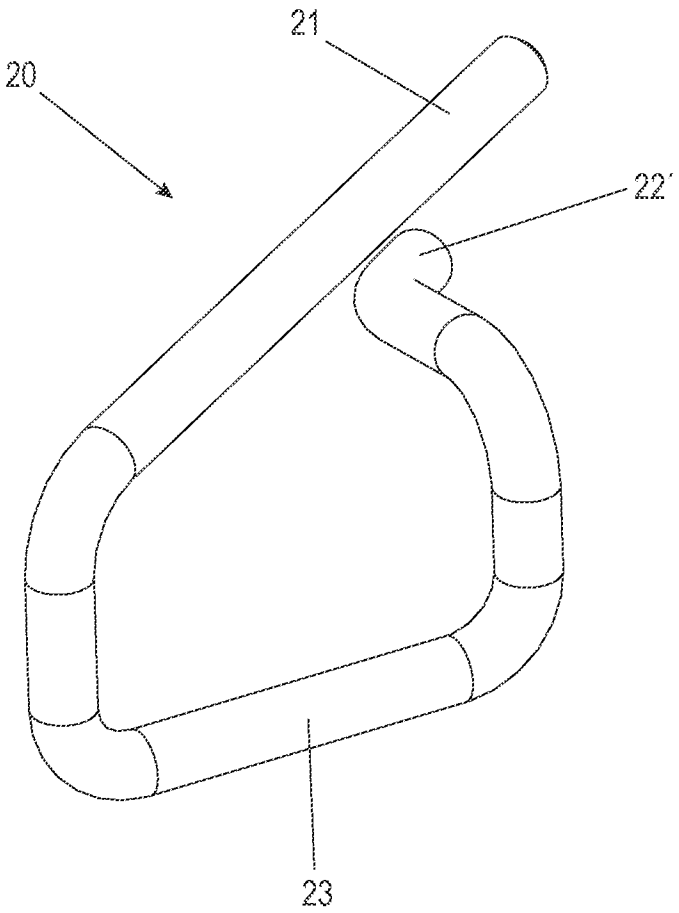
FIG. 12 shows a view of a modified locking element.

FIG. 12 shows the modified locking element 20, which is again formed from a metallic wire and comprises a rod-shaped actuating section 21 which is integrally formed with a bearing section 23. A locking section 22' adjoins the bearing section 23, which is shorter than the locking section 22 in FIG. 8 and serves only as a stop that can be brought into engagement with the locking projection 7, 7'.

Figure 13A:
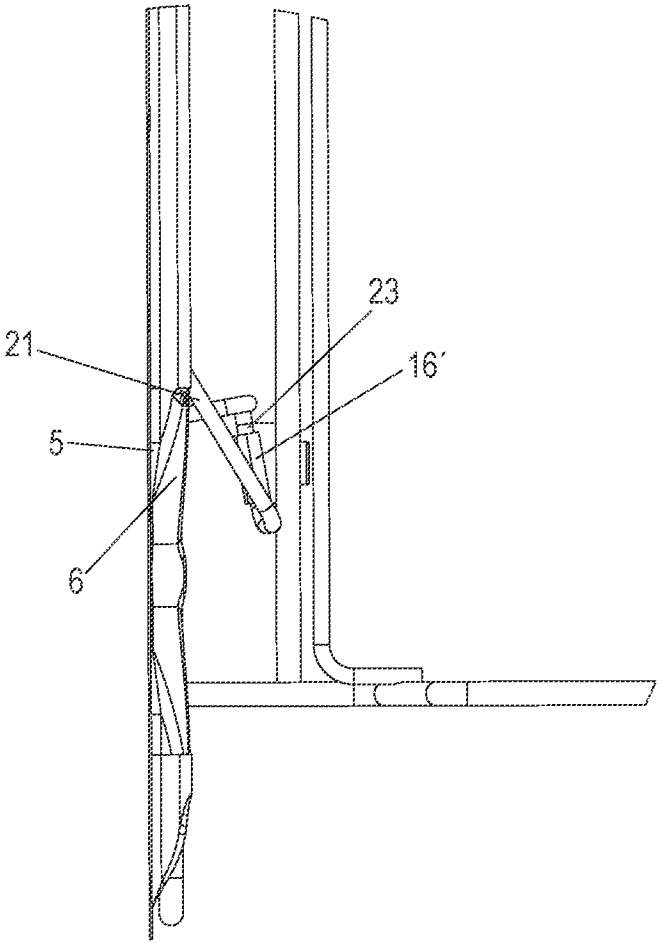
FIGS. 13A and 13B show two detailed views of a modified locking mechanism for the rack system in different positions.
Figure 13B:
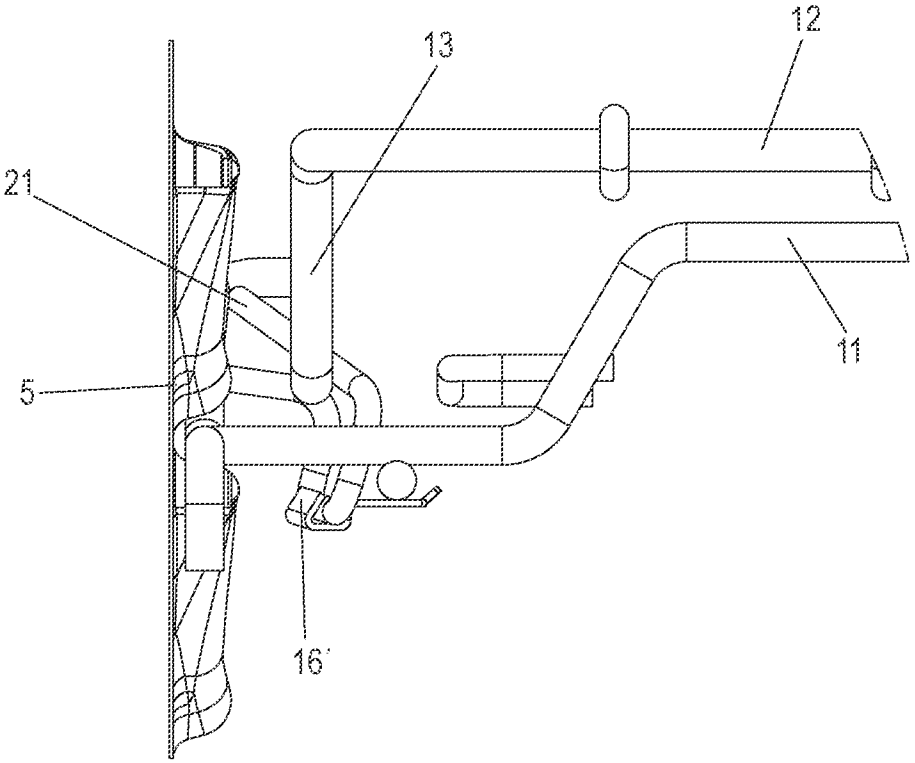

FIGS. 13A and 13B show a modified locking mechanism for a rack system 10. The driver 13 can move the actuating section 21 so that the locking section 22 is swiveled away from the wall element 5. In doing so, the locking element 20 rotates in a modified bracket 16', which does not hold the bearing section 23 parallel to the pull-out direction of the movable part 12 but at an angle thereto, for example at an angle of less than 30° parallel to the pull-out direction of the movable part 12. The bearing section 23 is aligned horizontally here.

Figure 14:
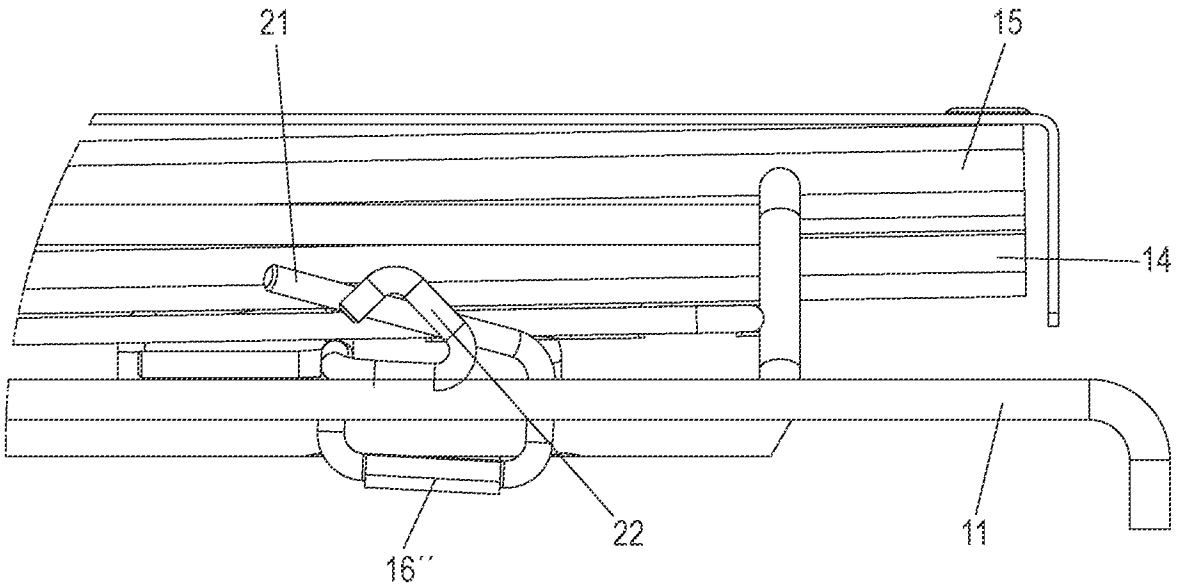
FIG. 14 shows another detailed view of a modified locking mechanism.

FIG. 14 shows a modified locking mechanism for a rack system 10, in which the locking element 20 is held in a modified bracket 16". The bearing section 23 is not aligned horizontally, but is held at an angle to the horizontal. Optionally, the bearing section 23 can be aligned at an angle of less than 30° parallel to the pull-out direction of the movable part 12.

Figure 15:
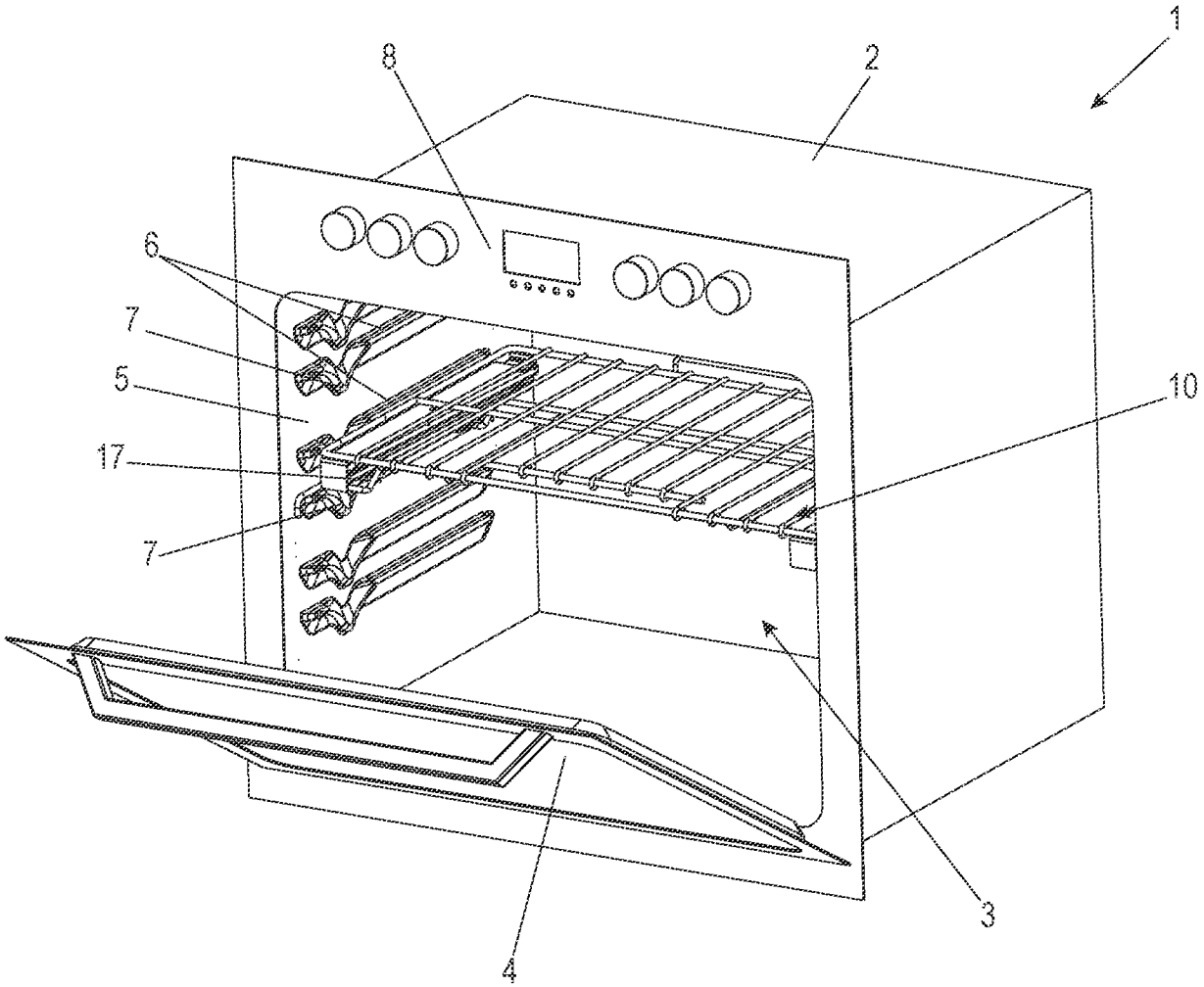
FIG. 15 shows a perspective view of a modified household appliance.

FIG. 15 shows a modified household appliance 1 in the form of a baking oven with a housing 2, in which a rack system 10 is arranged in an interior space 3. On opposite sides, the housing 2 includes a wall element 5 with a plurality of support strips 6, and a stationary part 11 of the rack system 10 is placed on one of the support strips 6. A movable part 12 with a grate is held movably on the stationary part 11, a pull-out guide 17 with rails that can be moved relative to one another being provided between the stationary part 11 and the movable part 12.

Figure 16:
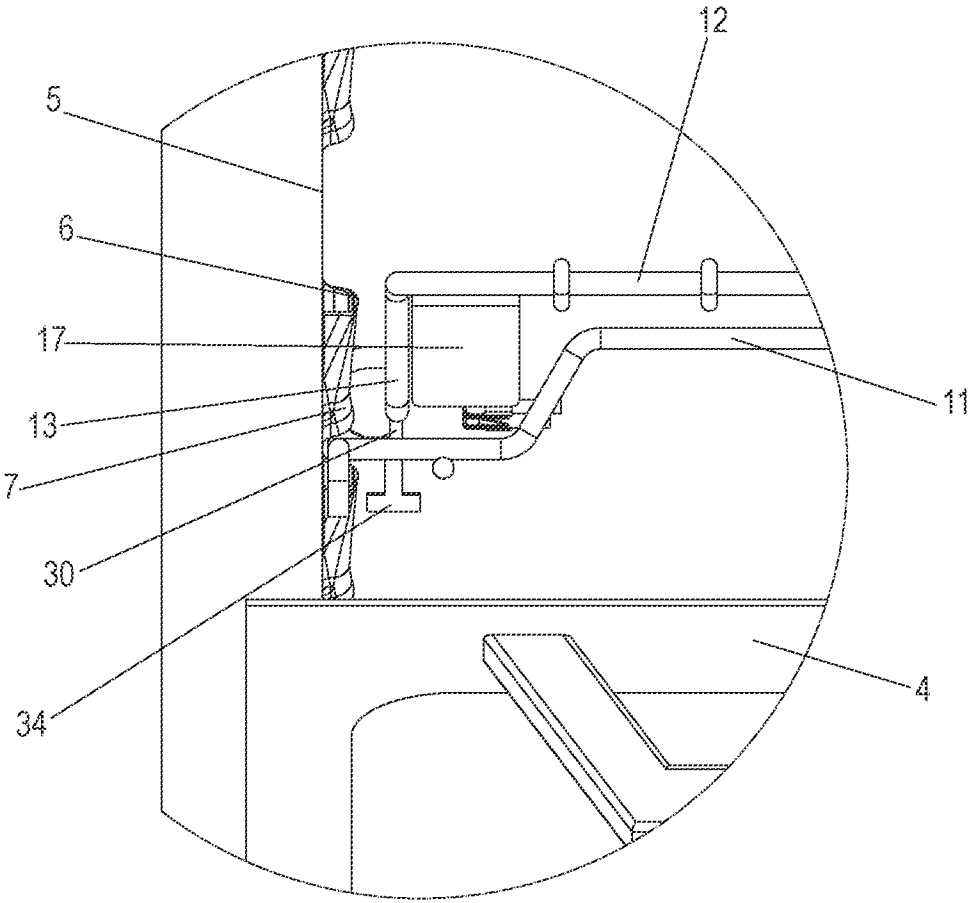
FIG. 16 shows a detailed view of the rack system of the household appliance of FIG. 15.

As can be seen in FIG. 16, a locking element 30 is located below a driver 13, by means of which the stationary part 11 can be locked to a locking projection 7 on the wall element 5. The driver 13 is located above the locking element 30 and can swivel the locking element 30 when moving in or against the pull-out direction.

Figure 17:
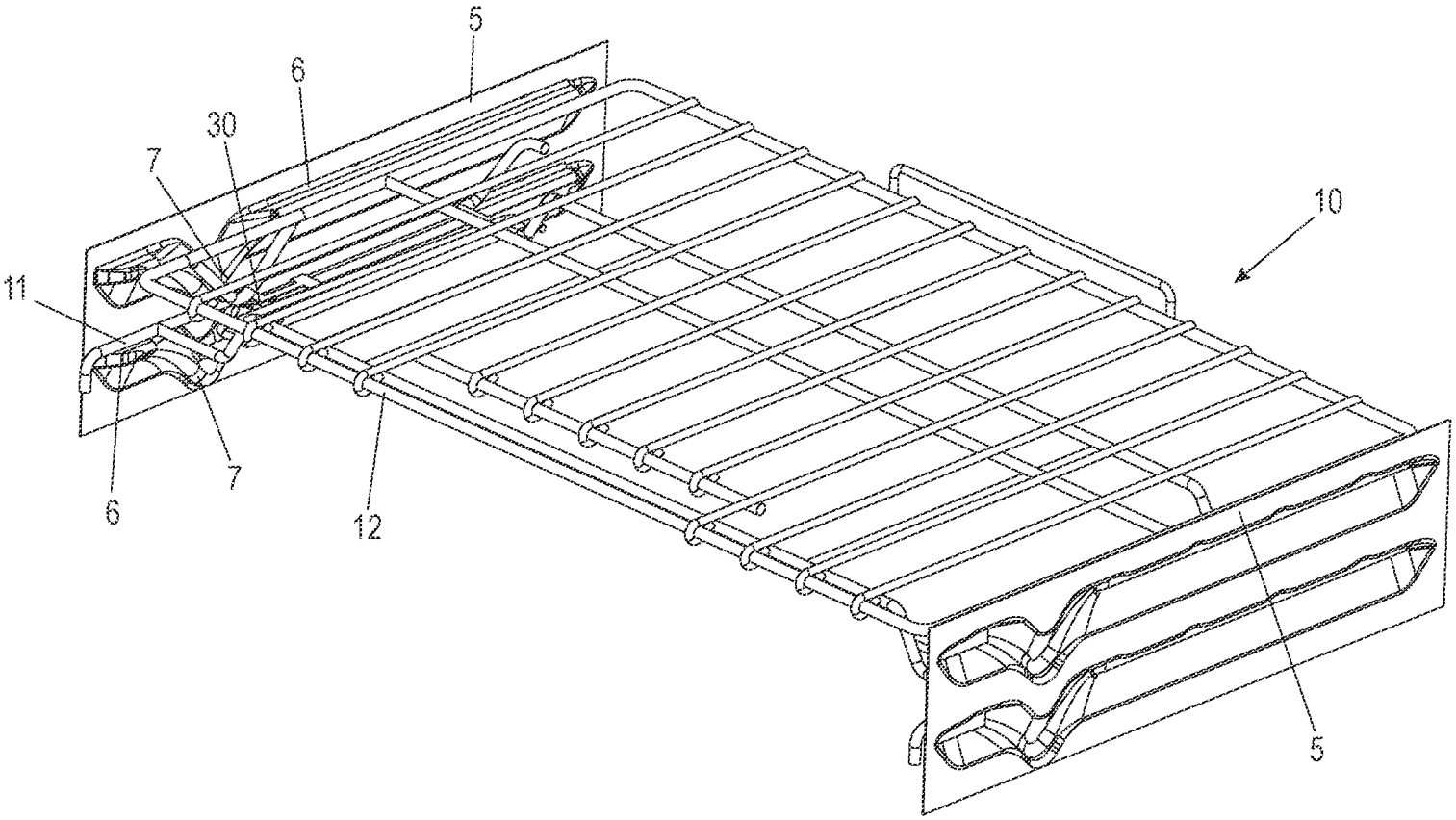
FIGS. 17 and 18 show two perspective views of the rack system of FIG. 15 in different positions.

In FIG. 17, the rack system 10 is shown between the two wall elements 5 in a run-in position. The movable part 12 is arranged above the stationary part 11 and between the two wall elements 5.

Figure 18:
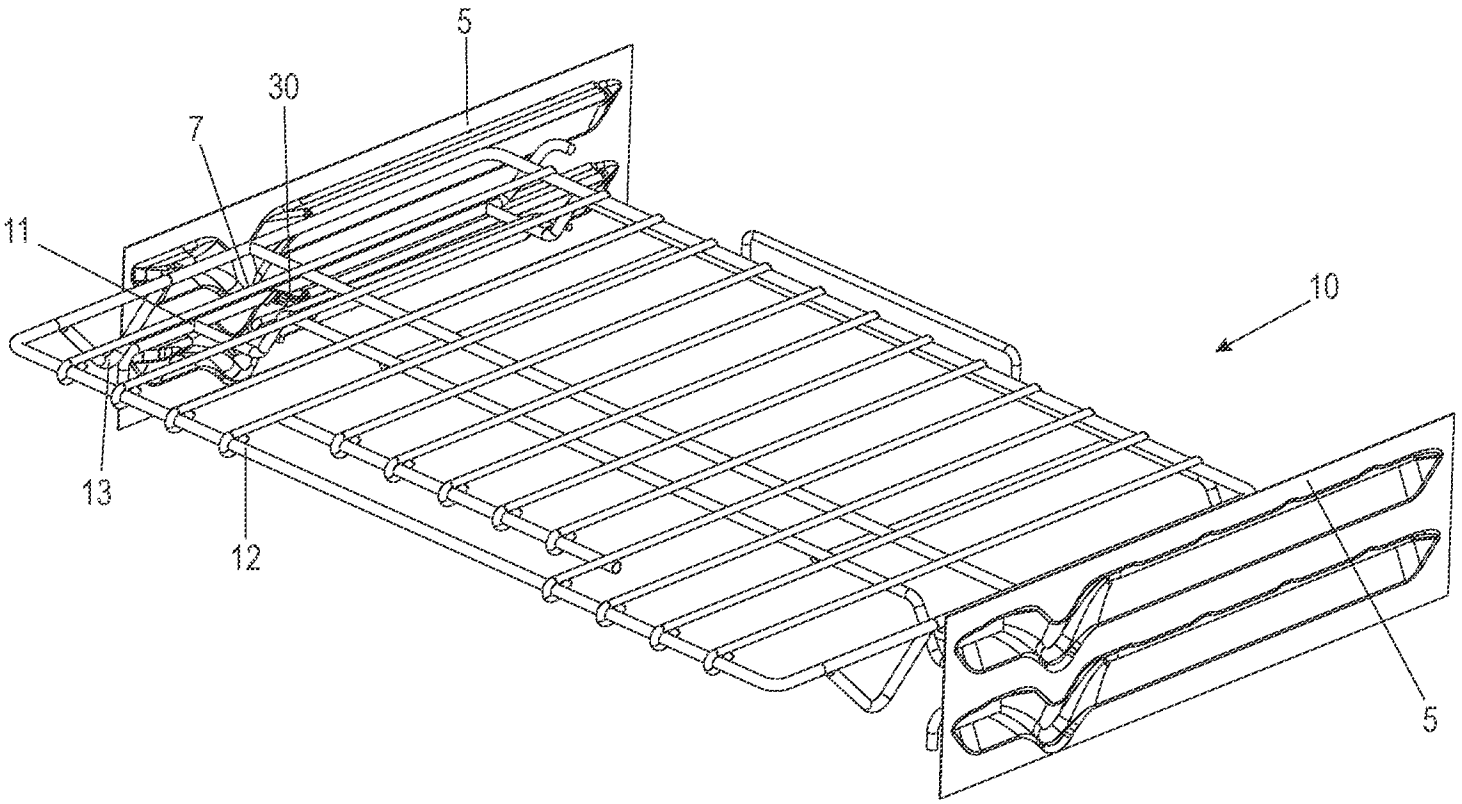

In FIG. 18, the movable part 12 of the rack system 10 has been moved in the pull-out direction relative to the stationary part 11, and the driver 13 provided on the movable part 12 is decoupled from the locking element 30, so that the stationary part 11 is now locked to the locking projection 7 of the wall element 5.

Figure 19:
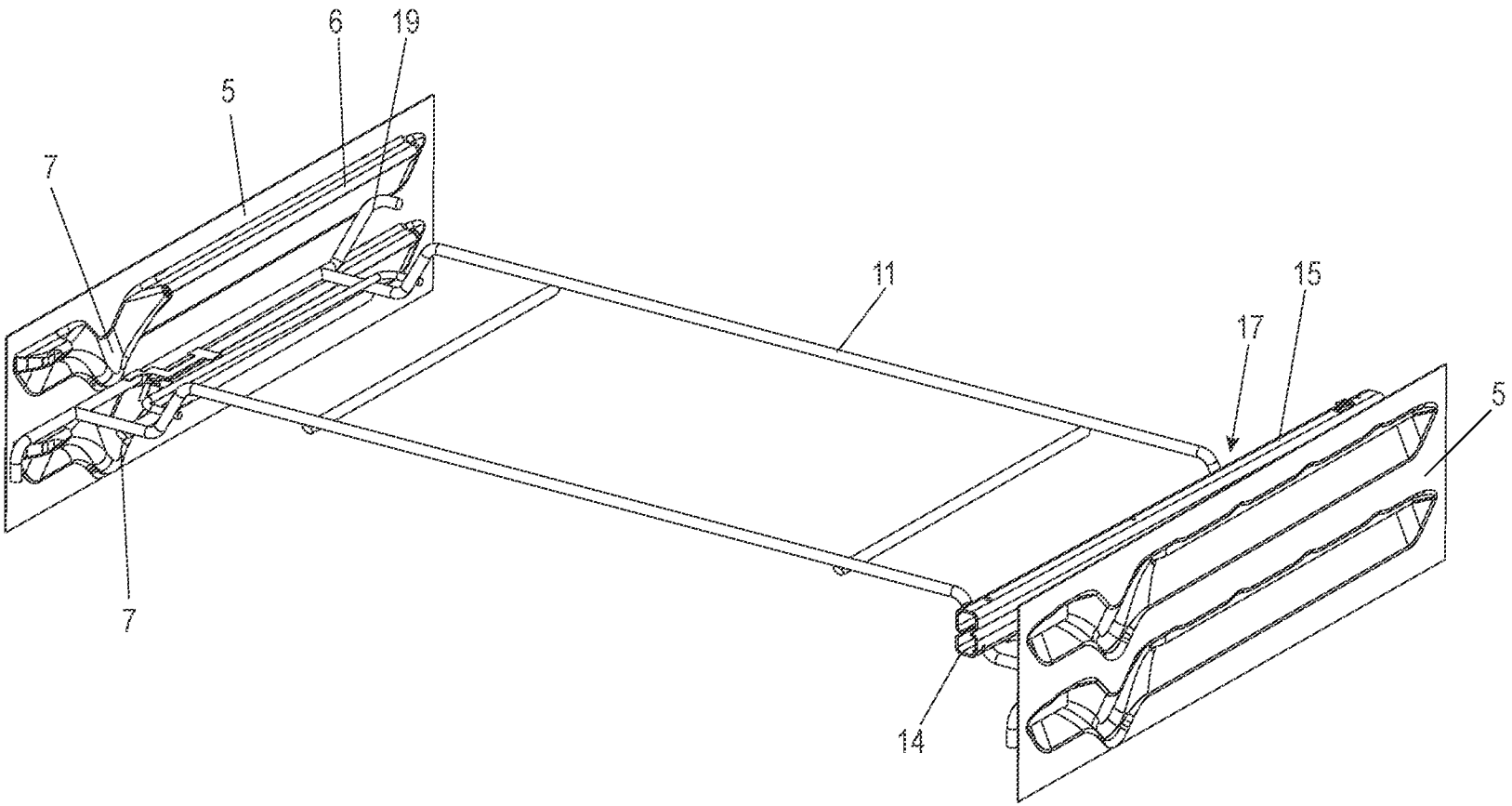
FIG. 19 shows a perspective view of the stationary part of the rack system of FIG. 17.

FIG. 19 shows the stationary part 11 of the rack system 10 without the movable part 12. The stationary part 11 rests on opposite sides with a strut on a support strip 6 and has an upwardly projecting projection 19 in the rear region, which can be placed against the underside of a support strip 6 in order to prevent the stationary part 11 from tilting. A pull-out guide 17 with a stationary rail 14 and at least one movable rail 15 is provided on opposite sides of the stationary part 11.

Figure 20:
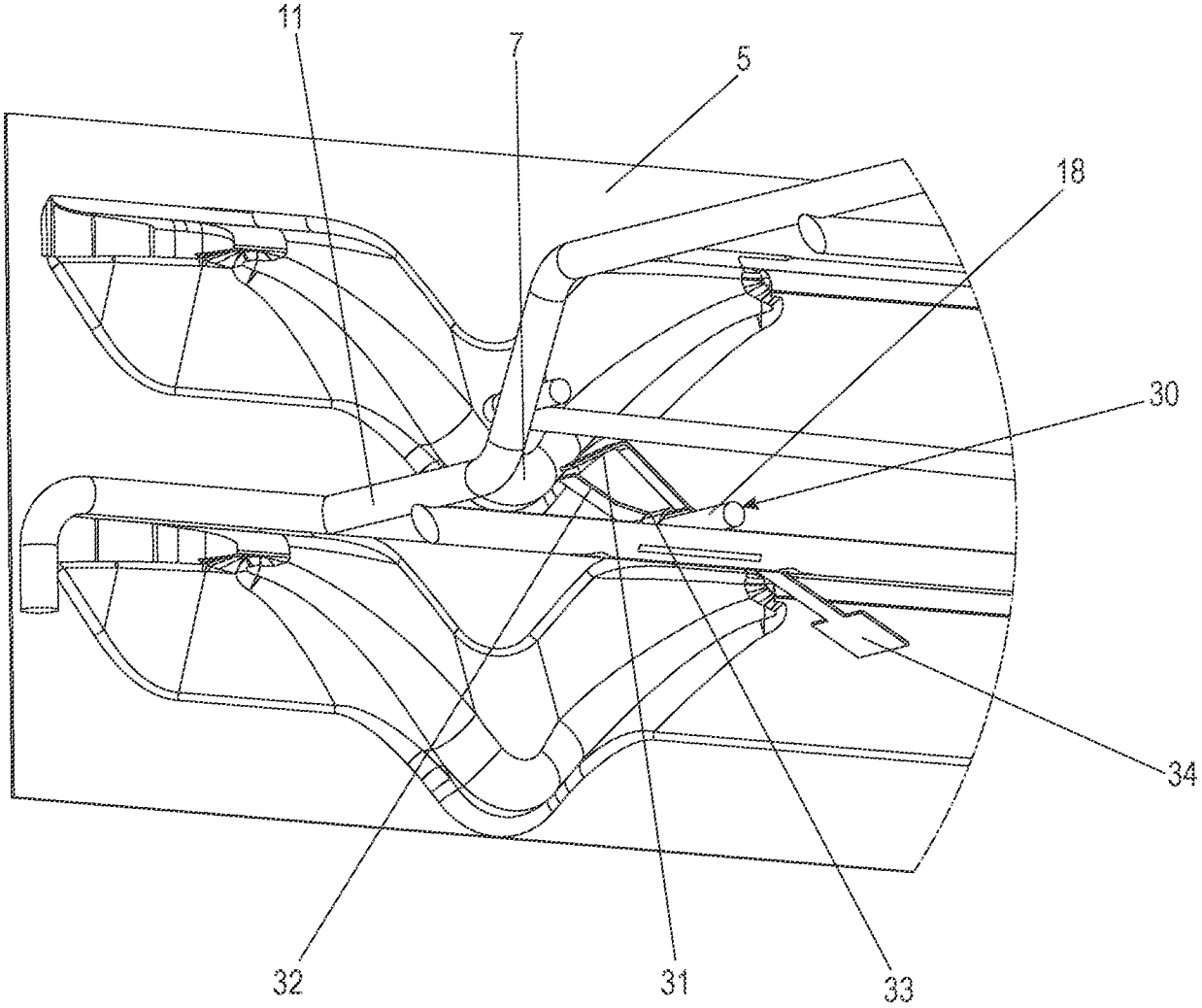
FIG. 20 shows a detailed view of the locking mechanism of the rack system of FIG. 17 in the locked position.

FIG. 20 shows the locking mechanism of the locking element 30 in detail. The locking element 30 includes an actuating section 31 which projects upwards and comprises a run-up slope against which the driver 13 comes when the movable part 12 is retracted, in order to pivot the locking element 30. The locking element 30 further includes a locking section 32, which is arranged adjacent to the locking projection 7 on the wall element 5 and ensures locking of the locking element 30 in a raised position. A bearing section 33 is formed between the locking section 32 and the actuating section 31, which is rotatable about an axis 18 of the stationary part 11. The bearing section 33 is arranged between the locking section 32 and the actuating section 31, and the locking element 30 is formed as a double lever with at least two lever arms. In the present case, the locking element 30 is connected to a third lever in the form of a cantilever 34, which extends from the bearing section 33. The cantilever 34 forms a weight element in order to pretension the locking element 30 about the axis 18 into a locked position.

Figure 21:
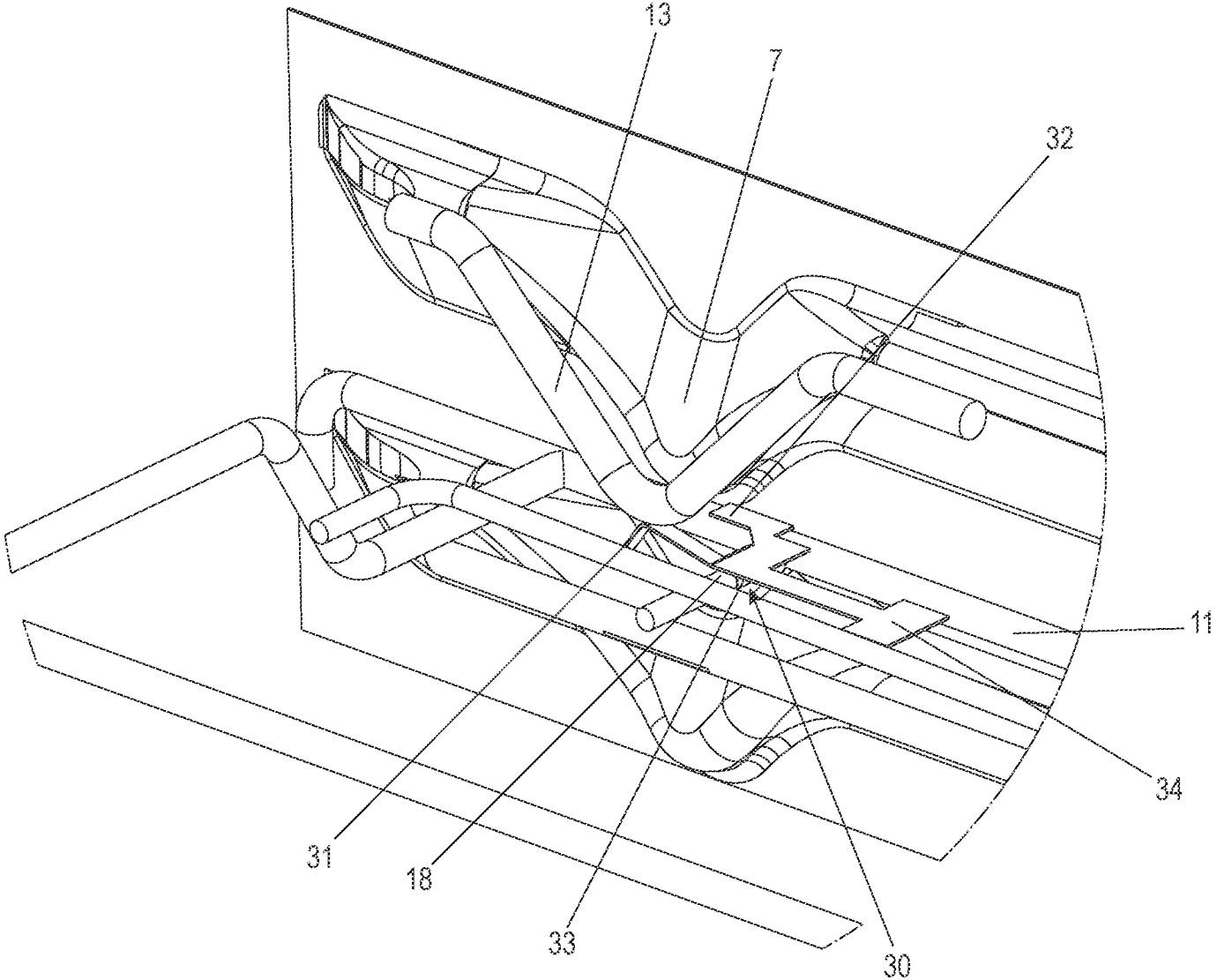
FIG. 21 shows a detailed view of the locking system of the rack system of FIG. 17 in the unlocked position.

When the driver 13 on the movable part 12 reaches a retracted position, the locking element 30 is pivoted anticlockwise about the axis 18, as shown in FIG. 21. The locking element 30 is then aligned substantially horizontally, and the locking section 32 moves out of engagement with the locking section 7, and the cantilever 34 protrudes from the bearing section 33 substantially horizontally.

In the embodiment example of FIGS. 15 to 21, the locking element 30 is made from a bent and punched metal sheet, but it can also consist of a different material and be manufactured using a different method.

In the embodiments shown, the driver 13 is formed integrally with the movable part 12, but can also be attached to it as an additional part. Furthermore, it is possible to fix or form the driver 13 on the movable rail 15 of the pull-out guide.

The embodiments described above can be combined with each other as desired. Preferably, at least one locking element 20 is provided on opposite sides of the rack system 10 in order to be able to securely fix the stationary part 11 in the household appliance 1. Optionally, it is also sufficient to provide only one locking element 20 on one side.

LIST OF REFERENCE SIGNS

1 Household appliance
2 Housing
3 Interior space
4 Door
5, 5' Wall element
6 Support strip
6' Rod
7, 7 Locking projection
10 Rack system
11 Stationary part
12 Movable part
13 Drivers
14 Stationary rail
15 Movable rail
16, 16', 16" Bracket
17 Pull-out guide
18 Axis
19 Projection
20 Locking element
21 Actuating section
22, 22' Locking section
23 Bearing section
30 Locking element
31 Actuating section
32 Locking section
33 Bearing section
34 Cantilever

What is claimed is:

1. A household appliance (1) with a rack system (10) and an interior space (3) for accommodating the rack system (10), wherein a wall element (5, 5') is provided on opposite sides of the interior space (3) and a locking projection (7, 7') is arranged on at least one of the wall elements (5, 5'), wherein the rack system (10) comprises a stationary part (11) arranged in the interior space (3) and a part (12) movable at least partially in front of the interior space via guides, and a locking element (20, 30) is provided on the stationary part (11) for detachable engagement with the locking projection (7, 7'), which is configured to be moved into an unlocked position via a driver (13) on the movable part (12), wherein the locking element (20, 30) is configured to be moved from the unlocked position into the locked position exclusively by gravity, wherein lifting of the locking element (20, 40) from a lowered locked position into a raised unlocked position relates to a center of gravity of the locking element (20, 30), which is lower in the lowered locked position than in the raised unlocked position, and the locking element (20, 30) is configured to be moved via the driver from the lowered locking position into a raised unlocked position or from a raised locking position into the lowered unlocked position.

2. The household appliance according to claim 1, wherein the locking element (20, 30) is pivotably mounted on the stationary part (11).

3. The household appliance according to claim 2, wherein the locking element (20, 30) is rotatable about an axis which extends substantially parallel to the pull-out direction of the movable part (12).

4. The household appliance according to claim 1, wherein the locking projection (7, 7') is arranged in the region of a front half of the wall element (5, 5') with respect to a pull-out direction of the movable part (12).

5. The household appliance according to claim 1, wherein a locking section (22, 22', 32) provided on the locking element (20, 30) is loaded in compression when a pulling force is applied to the stationary part (11) in the pull-out direction.

6. The household appliance according to claim 1, wherein the locking element (20, 30) has an actuating section (21, 31) which is configured to be brought into engagement with the driver (13), a locking section (22, 22', 32) which is configured to be brought into abutment to the locking projection (7, 7') and a bearing section (23, 33) for rotatable mounting of the locking element (20, 30), wherein the bearing section (23, 33) is arranged between the actuating section (21, 31) and the locking section (22, 22', 32).

7. The household appliance according to claim 1, wherein the driver (13) is arranged in a vertical direction above an actuating section (31) of the locking element (30) and presses the actuating section (31) downwards in the run-in position of the movable part (12).

8. The household appliance according to claim 1, wherein the locking element (30) comprises a cantilever (34) by means of which a locking section (32) of the locking element (30) is biased into a raised, locked position by gravity.

9. The household appliance according to claim 1, wherein a bracket (16, 16', 16") is fixed to the stationary part (11), which bracket forms a bearing receptable for the pivotable locking element (20, 30).

10. The household appliance according to claim 1, wherein the locking element (20) is formed from a bent wire.

11. The household appliance according to claim 1, wherein the stationary part (11) includes a first rail (14) and the movable part includes a second rail (15), which are held together displaceably via rolling elements.

12. The household appliance according to claim 1, wherein the locking element (20, 30) is provided on the stationary part (11) adjacent to each wall element (5, 5'), which locking element can be brought into engagement with a locking projection (7, 7').

13. The household appliance according to claim 12, wherein the locking projection (7) is formed on a wall element (5) from an embossed metal sheet.

14. The household appliance according to claim 12, wherein the locking projection (7') is formed on a side grate.

15. The household appliance according to claim 1, wherein the household appliance (1) is formed as a baking oven.

* * * * *